US007799389B2

(12) United States Patent
Borra et al.

(10) Patent No.: US 7,799,389 B2
(45) Date of Patent: Sep. 21, 2010

(54) METHOD AND DEVICE FOR DEPOSITING THIN FILMS BY ELECTROHYDRODYNAMIC, IN PARTICULAR POST-DISCHARGE, SPRAYING

(75) Inventors: Jean-Pascal Borra, Chevreuse (FR); Michaël Tatoulian, Paris (FR); Farzaneh Arefi-Khonsari, Chatenay Malabry (FR)

(73) Assignees: Centre National de la Recherche Scientifique, Paris (FR); Universite Pierre et Marie Curie (Paris VI), Paris (FR)

( * ) Notice: Subject to any disclaimer, the term of this patent is extended or adjusted under 35 U.S.C. 154(b) by 557 days.

(21) Appl. No.: 11/631,102

(22) PCT Filed: Jun. 28, 2005

(86) PCT No.: PCT/FR2005/001627

§ 371 (c)(1),
(2), (4) Date: Apr. 19, 2007

(87) PCT Pub. No.: WO2006/010845

PCT Pub. Date: Feb. 2, 2006

(65) Prior Publication Data

US 2008/0003374 A1 Jan. 3, 2008

(30) Foreign Application Priority Data

Jun. 28, 2004 (FR) ..... 04 07084

(51) Int. Cl.
*B05D 1/04* (2006.01)

(52) U.S. Cl. ..... 427/483; 427/475; 427/486; 427/535

(58) Field of Classification Search ..... 427/475, 427/483, 485, 535
See application file for complete search history.

(56) References Cited

U.S. PATENT DOCUMENTS

| | | | | |
|---|---|---|---|---|
| 5,618,589 | A | 4/1997 | McFarland | |
| 5,980,637 | A * | 11/1999 | Singh et al. | 118/641 |
| 6,679,441 | B1 | 1/2004 | Borra et al. | |

FOREIGN PATENT DOCUMENTS

| | | | |
|---|---|---|---|
| DE | 41 03 959 | A1 | 8/1992 |
| EP | 0 258 016 | A1 | 3/1988 |
| EP | 0258016 | * | 3/1988 |
| EP | 0 675 505 | A1 | 10/1995 |
| EP | 1 273 357 | A1 | 1/2003 |
| GB | 2 276 340 | A | 9/1994 |
| WO | WO 97/27346 | A1 | 7/1997 |
| WO | WO 99/49981 | A1 | 10/1999 |

* cited by examiner

OTHER PUBLICATIONS

Borra, Jean-Pascal, et al., "Polymer surface processing by atmospheric pressure DBD for post-discharge grafting of washing-resistant functional coatings", Trans Tech Publications, Materials Science Forum, Jan. 12, 2010, vols. 638-642, pp. 524-529.

*Primary Examiner*—Frederick J Parker
(74) *Attorney, Agent, or Firm*—Foley & Lardner LLP

(57) ABSTRACT

The invention concerns a method for depositing a thin polymer film on a substrate for functionalizing the surface of said substrate, comprising a step which consists in electrohydrodynamic spraying of a polymerizable precursor towards the substrate so as to produce an electrostatic deposition of electrically charged droplets of said precursor and form the thin film on the surface by polymerizing the droplets. The method is characterized in that it further comprises a step for causing the excited species to interact with the droplets of the sprayed precursor, thereby promoting the polymerization reactions of said precursor. The invention also concerns a device for implementing the method, in particular for depositing a thin polymer film on a moving substrate-film.

5 Claims, 1 Drawing Sheet

METHOD AND DEVICE FOR DEPOSITING THIN FILMS BY ELECTROHYDRODYNAMIC, IN PARTICULAR POST-DISCHARGE, SPRAYING

This application is a National Stage application of PCT/FR2005/001627, filed Jun. 28, 2005, which claims priority from French patent application FR 0407084, filed Jun. 28, 2004. The entire contents of each of the aforementioned applications are incorporated herein by reference.

The invention relates to depositing thin layers on a substrate for functionalizing the surface of the substrate by giving it suitable physicochemical properties for a given use.

More particularly, the invention relates to obtaining thin polymer layers from droplets of polymerizable precursors, the size and the electric charge of which are controlled in order to achieve a homogenous electrostatic coat and having a significant retention rate of the functionality and/or the structure provided by the precursor.

Forming deposits of functional or structural materials on a substrate is increasingly of interest in many industrial sectors, such as biotechnologies, the environment, the medical field, etc.

Forming such deposits is conventionally achieved by using so-called "wet" methods using significant amounts of organic solvents containing the diluted active ingredient. Such a use of solvents poses problems both from an environmental point of view and in terms of difficulties in transport and storage. Moreover, the "wet" methods involve rather long preparation times which may attain several days.

Plasma methods as for them are so-called "dry" methods which do not use solvents and the activation steps of which are fast as compared with conventional "wet" methods.

Plasma methods however have the drawback of low specificity of the functional grafting, notably when depositions are performed at atmospheric pressure.

At atmospheric pressure, grafting is actually limited by a restricted selection of gases (air, $N_2$, He for example) which makes selective grafting of functions impossible. The deposition techniques at atmospheric pressure moreover have problems of non-homogeneity, related to the presence of filamentary discharges (streamers) in the electric discharge which is performed for generating the plasma.

Research studies are presently focused on establishing luminescent discharges at atmospheric pressure, but many technical problems persist. In particular problems (of inhomogeneity and of relatively slow deposition rates of the order of a few tens of nanometer/min) may be mentioned.

Moreover, plasma methods generate a relatively strong decomposition of the precursor, which has the consequence of limiting the retention rate of the reactive function and causing poor homofunctionality at the surface of the substrate. As an example, in addition to the sought-after COOH functions, the presence of functions of type OH, C═O, C—O—R may thereby be observed.

In order to obtain better homogeneity of the discharge, one of the contemplated solutions consists of sweeping the deposition reactor with an inert gas which limits the partial pressure of oxygen and therefore the formation of ionization fronts. However, the inert gas flow rate is relatively large and contributes towards increasing the cost of such a solution. Moreover, the distances between electrodes of the order of a few millimeters, prevent the treatment of 3D objects.

The existing methods are therefore not totally satisfactory notably in that, in particular at atmospheric pressure, they have problems of inhomogeneity and of relatively slow deposition rate.

Accordingly there is a need for the possibility of depositing thin polymer layers without encountering the aforementioned drawbacks.

SUMMARY

The object of the invention is to meet this need, and proposes for this purpose and according to a first aspect, a method for depositing a thin polymer layer on a substrate for functionalizing the surface of the substrate, including an electrohydrodynamic spraying step of a polymerizable precursor towards the substrate in order to produce an electrostatic deposit of electrically charged droplets of said precursor and form the thin film on the surface of the substrate by polymerization of the droplets, the method being characterized in that it further includes a step for causing excited species to interact with the droplets of the sprayed precursor, thereby promoting the polymerization reactions of said precursor.

Certain preferred but non-limiting aspects of this method are the following:

- it includes a step for activating the surface of the substrate, performed by submitting the substrate to a plasma generated under the action of an electric discharge, said activation and spraying steps being applied simultaneously so that at least one portion of the gas species excited by the electric discharge will interact with the droplets of the precursor,
- it includes a step for forming said excited species, implemented by emitting photons by means of an UV lamp, said photons will then interact with the droplets of the precursor;
- the spraying step is performed in air at atmospheric pressure;
- the plasma is generated in air at atmospheric pressure;
- the electric discharge may be a continuous or alternating discharge;
- the method may be adapted for depositing a thin polymer layer on a moving substrate film;
- as the droplets are sprayed in a spraying area and the activation step is performed at an activation area, the spraying and activation areas may be located sufficiently near to each other so that the species excited by the electric discharge may interact with the droplets of the sprayed precursor;
- the excited species may also be carried away from the activation area towards the spraying area, so that at least one portion of the excited species may interact with the droplets of the sprayed precursor;
- the carrying away of the cited species towards the spraying area may be performed by submitted said species to a flow of gas;
- the activation area may be located upstream, in the direction of motion of the substrate film, from the spraying area, so that the spraying is performed on a portion of the substrate film, the surface of which has been activated beforehand;
- the method may further include a finishing step consisting of cross-linking the thin polymer layer deposited on the substrate.

The invention also relates, according to a second aspect, to a device for depositing a thin polymer layer on a substrate for functionalizing the surface of the substrate including means adapted for carrying out electrohydrodynamic spraying of a polymerizable precursor towards the substrate, so as to produce electrostatic deposition of electrically charged droplets of said precursor and form the thin polymer layer on the surface of the substrate, characterized in that it further includes means for forming excited species and in that said spraying and forming means cooperate so that at least one portion of the excited species interacts with the droplets of the sprayed precursor, thereby promoting the polymerization reactions of said precursor.

Certain preferred but non-limiting aspects of this device are the following:

- the means for forming excited species are means for activating the surface of the substrate, adapted in order to submit said substrate to a plasma generated under the action of an electric discharge, at least one portion of the gas species excited by the electric discharge interacting with the droplets of the precursor;
- the means for forming excited species comprise a UV lamp emitting photons, whereby said photons will then interact with the droplets of the precursor;
- the spraying means and the forming means are adapted so as to operate in air and in atmospheric pressure;
- the device may be adapted to depositing a thin layer on a moving substrate film on a transport mechanism, the droplets being sprayed in a spraying area, and the activation means are arranged so as to activate the surface of the substrate at an activation area located sufficiently near the spraying area so that the species excited by the electric discharge interact with the droplets of the sprayed precursor;
- the device may also include means, for example means for generating and directing a flow of gas, with which at least one portion of the species excited by the plasma may be carried away from the activation area to the spraying area;
- the activation means may be arranged upstream in the direction of motion relative to the spraying means;
- the spraying means may comprise means for collecting a discharge current in the gas surrounding the polarized liquid.

Figure 1:
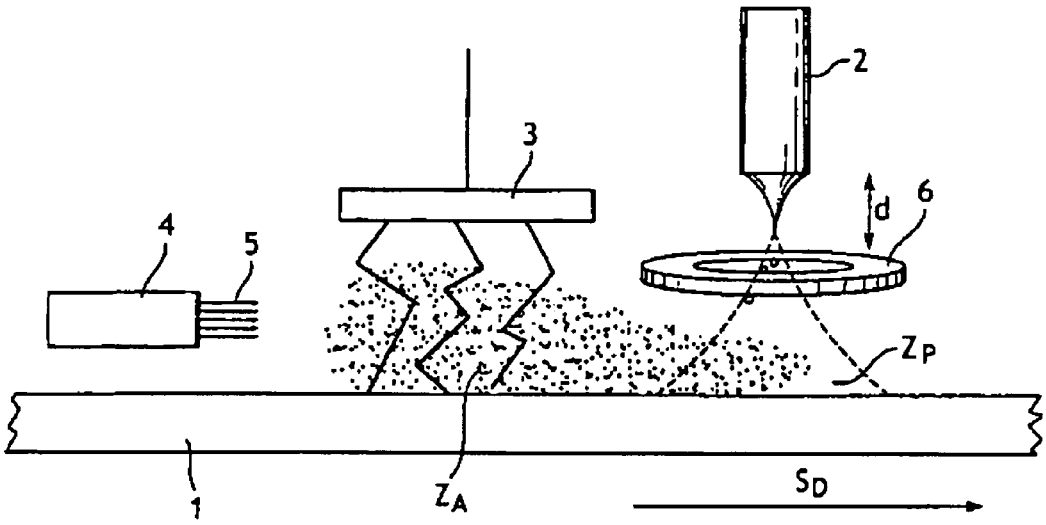
FIG. 1 illustrates a possible embodiment of a device according to a second aspect of the invention for functionalizing a moving substrate film.

Other aspects, objects and advantages of the invention will become apparent upon reading the following detailed description of preferred embodiments thereof, given as a non-limiting example and made with reference to the single appended FIGURE, which schematically illustrates a possible embodiment of a device according to the second aspect of the invention for functionalizing a moving substrate film.

DETAILED DESCRIPTION

The invention proposes achieving the deposition of a thin polymer layer on a substrate for functionalizing the surface of the substrate, the thin layer being obtained by polymerization on said surface of a polymerizable precursor.

In order to deposit a thin layer on a substrate, the invention generally proposes spraying a polymerizable precursor on the substrate.

The precursor may be organic, for example an unsaturated organic precursor. With the invention, an organic precursor generally polymerizable with difficulty by the known methods, of the saturated organic precursor type (such as an organo-silicon compound for example) may also be sprayed advantageously.

The precursor may also be inorganic.

Electrically charged droplets of the precursor are more specifically sprayed in order to achieve an electrostatic deposition and form by polymerization a thin polymer layer on the substrate.

The invention more specifically is based on spraying, as charged droplets, of a polymerizable precursor by spraying means of the electrohydrodynamic spraying (EHDS) type.

It is recalled here that with EHD spraying, a nebulisate of electrically charged liquid droplets may be produced. EHDS essentially consists of applying an electric field onto a liquid in order to induce at the surface of this liquid, electric charges with the same polarity as the voltage which is applied to it. These charges, accelerated by the electric field, generate a transformation of the liquid drop into a cone. At the apex of this cone, a jet of liquid is produced which fragments into droplets (nebulisate or spray).

By electrohydrodynamic spraying device is therefore meant here a device known per se with which a polarized liquid nebulisate may be generated, i.e., a liquid nebulisate sprayed into electrically charged droplets. Such a device comprises liquid supplying and distributing means and means for electrically polarizing the surface of this liquid. The liquid distributing means are provided with a conduit at an outlet (essentially consisting of a spray nozzle) from which the polarized liquid forms a conical meniscus, at the apex of which a jet and then a dispersion of electrically charged liquid droplets are emitted.

A description of an EHDS device will be found in document WO 99/49981, for example.

According to an advantageous embodiment of the invention, the EHDS device may further include means with which, during spraying of the liquid, a discharge current may be collected in the gas surrounding the polarized liquid, such as notably a conducting material having an aperture with a shape and dimensions providing the passage for letting through the sprayed liquid (no collection of droplets) while providing the electric field conditions required at the surface of the liquid in order to allow spraying.

Such means for example consist of a counter electrode, or a conducting material connected to the ground or polarized, placed at a distance d (of the order of a few millimeters) at the outlet of the conduit. Such means may notably have an annular shape, as this is illustrated under reference 6 in FIG. 1.

Such means are particularly suitable for making sure that the field at the surface of the liquid in the spraying area remains independent of the charge densities under the ring. The conditions for producing droplets may thereby be maintained constant in the spraying area. It is then possible to obtain better spreading of the sprayed droplets, and therefore a more homogenous deposit, and this regardless of the surface potential of the substrate.

When the device according to the invention includes a plurality of spray nozzles, such means may consist of a plate connected to the ground and including a plurality of holes, each hole acting as a ring associated with a particular nozzle.

Within the scope of the invention, the liquid may be a standard solvent such as water, ethanol or acetone, in which a polymerizable precursor, notably an organic polymerizable precursor is dissolved.

The flow rate of the liquid and its conductivity, the voltage applied to the liquid, as well as the geometry of the spray nozzle, are the control parameters with which the size (from 0.5 to 200 μm) and the charge (from $10^{-3}$ to 1 C/kg, either positive or negative) of the droplets may be controlled, as well as their spray mode (notably a "cone-jet" monomode or "cone-jet" multimode).

These control parameters give certain flexibility to EHDS. It is thereby possible to spray droplets of different precursors in air and at atmospheric pressure, from a spray nozzle up to the surface of the substrate to be treated.

This flexibility moreover provides control (notably controlling the size of the droplets) of the evaporation conditions for the droplets and consequently of their polymerization kinetics, as well as of the thickness (typically between 0.01 and 10 μm) of the dry polymer deposited or formed on the surface of the substrate.

The applicants were able to ascertain that the polymerization processes of the polymerizable precursor may be promoted by using EHDS, and this when the droplets are in suspension during the transit from the spray nozzle to the surface of the substrate to be treated, and/or when the droplets are deposited on the surface of the substrate.

Moreover, with EHDS, it is possible to avoid the fragmentation processes of the precursor generally observed when plasma methods are used (for which the precursor is degraded by the electrons and by the short life-time species excited by the plasma, which leads to a low retention rate of the active function).

Production of precursor droplets by electrohydrodynamic spraying thereby provides an improvement in the polymerization performances, by associating a strong retention rate with very significant deposit/substrate adhesion, so that a good number of applications may be contemplated, for example in the biotechnological sector.

Additionally, EHDS only requires a limited consumption of confined (and therefore non-polluting) solvent, and it may be applied with low costs, both energy (typically less than 1 Watt/cm$^2$) and maintenance costs as compared with those for plasma installations.

As an example, with the invention, deposition of reactive functions such as carboxylic, alcohol or primary amine functions may thereby be performed, in order to produce selective functional grafting on the substrate.

With the invention, it is also possible for example to produce ammonium deposits (notably for bactericidal applications), fluorinated deposits (notably for membrane filtration applications), or even deposits of the $TiO_2$ or $SiO_2$ type from organo-silicon compounds.

According to an embodiment of the invention, and as this is illustrated in FIG. 1, the substrate is a film 1 moving in the direction indicated by the arrow $S_D$ on a transport mechanism (not shown). The device for depositing a thin functionalized layer on the moving substrate film comprises a EHDS device comprising one or more spray nozzles 2 positioned so that the droplets will be deposited on the moving substrate film 1.

With EHDS, it is actually possible to produce deposits at a high rate so that functionalization may be performed on a high speed moving film, for example at a velocity of the order of a few hundreds of m/min; notably when several spray nozzles are used simultaneously.

It will further be noted that with EHDS, it is possible to produce deposits of thin layers not only on 2D substrates, but also on 3D objects, while exhibiting a high retention rate, and this without any homogeneity constraint in thickness.

The method according to the invention further include a step directed to causing excited species to interact with the droplets of the sprayed precursor, so as to promote spraying reactions of said precursor.

According to a first possible embodiment of the method according to the invention, the latter includes a step for activating the surface of the substrate, performed by submitting the substrate to a plasma generated under the action of an electric discharge, said activation and spraying steps being applied simultaneously so that at least one portion of the gas species excited by the electric discharge interacts with the droplets of the precursor.

According to a second possible embodiment, either taken alone or combined with the first embodiment, excited species will be formed by means of an UV lamp, the photons emitted by the lamp then playing the role of the excited species which interact with the droplets of the precursor.

The activation step may be performed by a means for activating the surface of the substrate generating a cold plasma under the action of an electric discharge.

The electric discharge may be a continuous (DC), alternating (AC) or pulsed discharge.

The discharge preferentially used is a discharge which may be applied in ambient air at atmospheric pressure, such as for example the alternating discharge known as Dielectric Barrier Discharge (DBD).

It is recalled that DBD is obtained for example by applying a high voltage pulse to the terminals of two electrodes, one of which is covered with a dielectric material which prevents the arc from passing through. Multiple plasma filaments may thereby be obtained in air, at atmospheric pressure, for a series of discharges created between both electrodes.

With the electric discharge, it is possible to generate excited species (photons, radicals, electrons, molecules excited at different electronic, rotational and vibrational levels) capable of interacting with the surface to be treated in order to activate it, notably before but also after performing the deposition of the thin layer.

With this activation, radical sites may be created which are capable of allowing covalent bonds to be formed at the deposit/substrate interface and the deposit to be spread out on the surface of the substrate.

With this activation, it is also possible to perform preliminary cleaning of the substrates which are generally contaminated and to guarantee good deposit/substrate adhesion.

Moreover, with activation in air of the surface of the substrate, polar functions may be grafted on the substrate, thereby improving the wettability properties of the latter.

In the fields of application in biotechnology, washings in solution of the functionalized substrates should generally be performed, for which the thin film deposited according to the deposition methods conventionally used, may be lost or at the very least damaged. It is understood that improvement in wettability is of interest in that the stability required for withstanding washings may be imparted to the deposited layer, notably within the scope of applications in solution.

Moreover, it will be noted that the flow of the excited species may also contribute towards cross-linking of the deposited thin layer, and therefore towards its stability to washing (in particular, water-insoluble deposits may be achieved).

The activation step is generally performed so that the area of the substrate on which the droplets are sprayed, has been activated beforehand. However, it will be noted that it is also possible to activate an area of the substrate after the latter has undergone spraying.

Thus the case may be considered as illustrated in FIG. 1, when the activation step and the spraying step are applied simultaneously, for example when the question is to produce deposition of a thin layer on a moving substrate film 1. The activation means 3 are then arranged upstream from the EHDS device 2 in the direction of motion indicated by the arrow $S_D$, so that the portion of the film on which the sprayed droplets are deposited, has already been activated beforehand.

In such a case, the activation means 3 and the EHDS device 2 are preferentially separated from each other by a minimum distance of the order of the inter-electrode distance (typically from about 5 to 10 cm), by which the EHDS device may be protected against electric influences of the electric discharge activation means.

According to a preferred embodiment of the invention, when the activation and spraying steps are applied simultaneously as mentioned above, the device according to the invention also includes means 4 with which the species excited by the plasma of the surface activating means 3 may interact with the droplets emitted by the spraying device 2, the excited species being carried away from the activation area $Z_A$ to the spraying area $Z_P$.

By activation area $Z_A$ is meant the inter-electrode area of the activation means 3 in which the electric discharge is performed for plasma activation.

By spraying area $Z_P$ is meant the area in which the sprayed droplets are in suspension but also deposited on the substrate.

A device according to a possible embodiment of the invention may for this purpose include means 4 for generating and directing a flow of gas 5 (for example an $N_2$, Ar ou He flow) in order to carry away at least one portion of the excited species from the plasma activation area $Z_A$ to the spraying area $Z_P$ in which the droplets are sprayed.

These excited gas species brought into the spraying area will actually provide improvement in the polymerization reactions by interacting with spray droplets when the latter are in suspension and/or deposited at the surface of the substrate.

This improvement proves to be particularly of interest as regards the polymerization of a precursor, generally difficult to polymerize by means known in the prior art, such as a saturated precursor. Advantageously, with the invention, it is thereby possible to conduct polymerization reactions with saturated precursors.

Of course, a device according to one embodiment of the invention may also be configured in such a way that the activation means are arranged sufficiently near the spraying means so that at least one portion of the excited species may come to interact with the sprayed droplets in the spraying area, and this without the need of any particular means (such as stripping means of the gas flow type) for this interaction to occur.

Moreover, it is mentioned that the device according to the invention is not limited to a serial layout of the activation means and of the spraying device. One skilled in the art will be able to provide the described and illustrated embodiment with many alternatives or modifications.

In particular, it is understood that the described device may easily be modified by one skilled in the art so that the activation means and the spraying device are laid out in parallel, so that deposition of a thin polymer layer is performed according to a transverse or longitudinal sweep of the substrate, etc.

Moreover, as this was already emphasized earlier, the invention is not limited to excited species of the gas species type, excited by an electric discharge, but it also extends to excited species of the photon type generated by a UV lamp. In such a case, the UV lamp will preferentially be laid out so that the beam of photons directly interacts in the spraying area $Z_A$ with the droplets generated by the EHDS device.

For this purpose the UV lamp may be placed near the spray nozzle(s) of the PHED device. The UV lamp should however not change the electric field lines at the origin of the spraying, and is therefore typically placed at a distance from the nozzle, larger than the nozzle-substrate distance.

As an example, the lamp may be oriented perpendicularly to the height of the spraying cone so that the photons will interact with the whole of the sprayed precursor droplets.

Moreover, it is mentioned that within the scope of deposition on a moving substrate film, an UV lamp may be set up upstream and/or downstream from the spraying nozzle.

Once the thin layer is deposited on the substrate, the latter may be submitted to one or several finishing steps, for example aimed at cross-linking in volume the deposited polymer layer and/or at modifying the surface of the deposited thin layer, notably for its conditioning (notably by winding it).

These finishing steps may be performed by submitting the substrate to drying, for example under an UV lamp, or to an electric discharge.

The main advantages of the invention are recalled hereafter. First, with the invention, it is possible to produce deposition of functionalized thin layers on a substrate in air or at atmospheric pressure. In particular, it is therefore unnecessary to use a pumping system for reaching the low pressures required for low pressure plasma deposition.

The reactive function further has a high retention rate guaranteeing a high density of grafted functions, indispensable for certain applications, in particular in the biotechnological sector.

Moreover good adhesion of the thin layer on the treated surface is observed.

The invention may be applied with a large selection of organic precursors, so an extension of the field of application of functionalized thin layers may be contemplated.

As this was mentioned earlier, by the interaction of excited species and of sprayed droplets, polymerization of saturated precursors of the organo-silicon type may be contemplated (for example for applications in the packaging sector by $SiO_2$ layer deposition acting as a barrier layer to water and oxygen).

Deposition rates are moreover high and compatible with a motion of substrate films of the order of a few hundreds of m/min.

The invention may also be used for producing deposits on 3D objects.

Moreover, the costs in energy are low (less than 1 Watt/$cm^2$), and the installation costs (a pumping system is not required, limited consumption of organic precursor) and maintenance costs (as compared with existing installations for plasma deposition for which corrosion is observed because of the oxidizing properties of the discharges at atmospheric pressure in air) are reduced.

The description hereafter relates to various applications of the invention. These applications generally cover the field of surface treatments with, i.a, the sector of biotechnologies, the environmental sector, the medical sector, the glass industry, etc.

As for the biotechnological sector, it is possible to cite in a non-limiting way, production of DNA chips (for example for identifying proteins), production of enzymatic supports from functionalized polymer materials (notably for detecting biological contaminants suspended in air and/or in water).

As for the medical sector, it is possible to cite in a non-limiting way, improvement of the biocompatibility of materials which should be implanted in human beings, development of bactericidal properties from functionalized supports of the primary amine type (for example in order to control nosocomial infections or cleaning up ventilation air), biological sensors (for example by grafting antibodies for detecting food toxins).

As for the environmental sector, it is also possible to cite the production of biological sensors (for example by grafting specific antibodies for detecting pesticides such as Isoproturon).

The invention claimed is:

1. A method for depositing a polymer layer on a moving substrate for functionalizing a surface of the substrate, comprising the steps of:

electrohydrodynamic spraying a polymerizable precursor towards the substrate in order to produce electrostatic deposition of electrically charged droplets of said precursor, causing excited species to interact with the droplets of the precursor sprayed on the substrate, thereby promoting polymerization reactions of said precursor, wherein the excited species are radical sites generated by a surface activation step of the substrate surface being carried out by a plasma generated in air, at atmospheric pressure under action of dielectric barrier discharge (DBD), and wherein the droplets are sprayed in a spraying area and the surface activation step is performed at an activation area located upstream, in a direction of the motion from the spraying area, so that spraying is performed on a portion of the substrate, the surface of which has radical sites that interact with the droplets of the precursor sprayed on the substrate so that covalent bonds are formed at the deposition/substrate interface.

2. The method according to claim 1, wherein the spraying step is performed in air at atmospheric pressure.

3. The method according to claim 1, wherein said spraying and activation areas are located sufficiently near to each other so that the species excited by the electric discharge may interact with the droplets of the precursor sprayed on the substrate.

4. The method according to claim 1, wherein the method further includes a finishing step consisting of cross-linking the polymer layer deposited on the substrate.

5. The method according to claim 1, wherein the sprayed precursor is an unsaturated or saturated organic precursor.

* * * * *